US005655243A

United States Patent [19]

Kim

[11] Patent Number: 5,655,243

[45] Date of Patent: Aug. 12, 1997

[54] METHOD FOR CONNECTING PRECAST CONCRETE BEAMS

[76] Inventor: Sun Ja Kim, Impchang Apt. 3 dong 508 ho, Jungan-dong 187-26, Eunpyung-ku, Seoul, Rep. of Korea

[21] Appl. No.: 502,602

[22] Filed: Jul. 14, 1995

[51] Int. Cl.[6] ..... E01D 21/00

[52] U.S. Cl. ..... 14/74.5; 14/77.1; 52/726.2; 264/35; 264/228

[58] Field of Search ..... 14/73, 74.5, 77.1, 14/73.1; 52/223.1, 223.6, 223.7, 223.8, 223.9, 223.11, 726.1, 726.2, 747.12, 742.14, 742.15; 404/47, 70, 74; 264/35, 228

[56] References Cited

U.S. PATENT DOCUMENTS 3,882,564 5/1975 Muller ..... 14/77.1 X

FOREIGN PATENT DOCUMENTS 1174514 8/1985 U.S.S.R. ..... 14/74.5
1454905 1/1989 U.S.S.R. ..... 14/77.1
1486546 6/1989 U.S.S.R. ..... 14/77.1
1513069 10/1989 U.S.S.R. ..... 14/73
1411980 10/1975 United Kingdom ..... 52/223.11

OTHER PUBLICATIONS

"A New Splicing Technique to Create Continuity in Prestressed Concrete Members", PCT Journal, Sep./Oct. 1993, pp. 30–37.

*Primary Examiner*—James A. Lisehora
*Attorney, Agent, or Firm*—Burns, Doane, Swecker & Mathis, L.L.P.

[57] ABSTRACT

A connection method for connecting precast concrete beams involves supporting both ends of the precast concrete beams, lifting up the central points of the precast concrete beams, placing concrete in the gaps between the ends of the precast concrete beams, and positioning tendons through anchor blocks which project from the precast concrete beams. The tendons are then tensioned and, substantially simultaneously, the lifting forces applied to the concrete beams are reduced. The connection method reduces the bending moment caused by the self-weight of precast concrete beams and, as a result, reduces the size of the beam section.

2 Claims, 3 Drawing Sheets

METHOD FOR CONNECTING PRECAST CONCRETE BEAMS

BACKGROUND OF THE INVENTION

1. Field of the Invention

The present invention relates to a method for connecting precast concrete beams in construction work, for example, bridge superstructures.

2. Description of the Prior Art

In recent years, precast concrete beams for the bridge superstructures have occasionally been connected to make a continuous beam, because it is possible to employ smaller concrete sections, thus reducing the dead weight of structure and attaining the resulting economy.

Several methods are being used for connection of precast concrete beams. Most methods utilize the following: (a) precast concrete beams are supported by the piers, (b) concrete is placed into the gaps between the ends of beams, and (c) tendons or reinforcing bars are utilized so that structural continuity is achieved.

In these methods, however, structural continuity is effective only for loads that are applied after the structural continuity is achieved.

The self-weight of beams is applied before the structural connection, and so the structural continuity is not effective for this load.

So, in order to attain full economy, an active method is needed to make it possible so that structural continuity is effective for the self-weight of precast concrete beams.

SUMMARY OF THE INVENTION

It is an object of the present invention to provide a method for connecting precast concrete beams in which the structural continuity is effective for the self weight of beams.

The object of the present invention is accomplished as follows:

First, precast concrete beams are put on the piers and supported at both ends. Then lifting forces are applied to the central points of spans by means of hydraulic jacks with temporary piers or other lifting equipments. The lifting force is smaller than the self-weight of a beam, so that the beams do not move out from the piers. While the lifting forces are maintained constantly, concrete is placed into the gaps between the ends of beams and then cured.

After the concrete has hardened, tendons are positioned, tensioned and then anchored through the anchor blocks, which project from the beams. As the tensioning work performed, the lifting forces applied to the central points of spans are reduced at the same rate.

When tensioning work is finished, the lifting forces become zero and by this concurrent tensioning and lowering work, the bending moment caused by lowering of the central points is distributed through the connection part, and as a result, structural continuity is maintained.

After tensioning and lowering works are finished, the bending moment at the midspan of the connected beam is smaller than that of simple beams.

BRIEF DESCRIPTION OF THE DRAWINGS

FIG. 6 shows the bending moment diagrams for the working stages;

A) bending moment of beams supported at both ends

B) bending moment with the lifting forces applied to the central points of the spans C) bending moment after the tensioning and lowering work finished.

DETAILED DESCRIPTION OF THE PREFERRED EMBODIMENT

This embodiment is preferably applied to the connection of two spans of precast concrete beams as shown from FIG. 1 to FIG. 6.

This embodiment is merely intended to illustrate the present invention in detail and should not be considered to be a limitation on the scope of the invention.

a) First step

Figure 1:
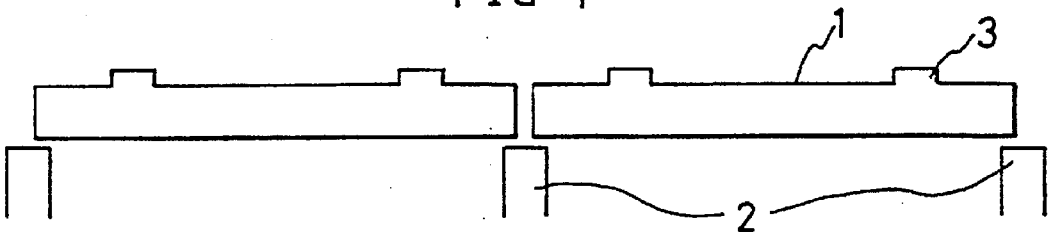
FIG. 1 is a schematic view showing the first step of connection work; precast concrete beams are supported on the piers.

Two precast concrete beams 1 are put on the piers 2 as shown in FIG. 1.

They are supported at the both ends, and the bending moment caused by the self weight of beam has the form as shown in the diagram of FIG. 6(A).

b) Second step

Figure 2:
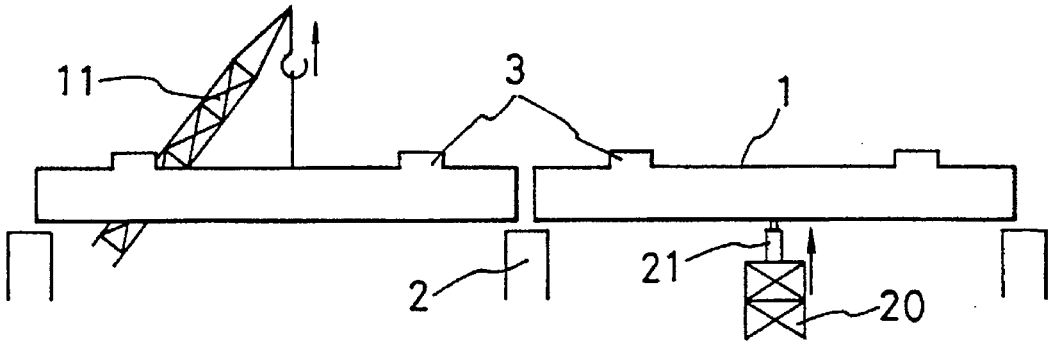
FIG. 2 is a schematic view showing the second step of connection work; lifting forces are applied to the central points of the spans.
Figure 3:
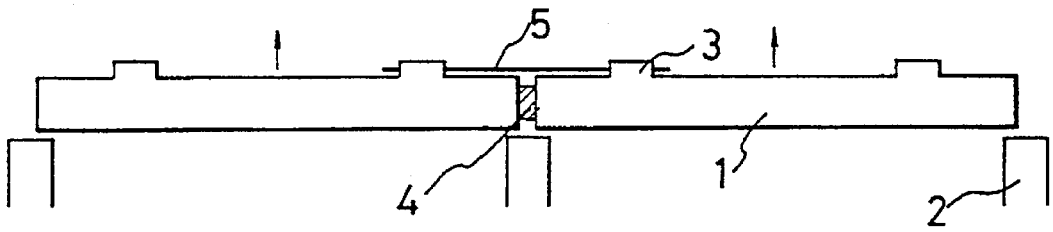
FIG. 3 is a shematic view showing the third step of connection work; concrete is placed into the gap between the ends of the beams and tendons are positioned through the anchor blocks projecting from the beams.
Figure 4:
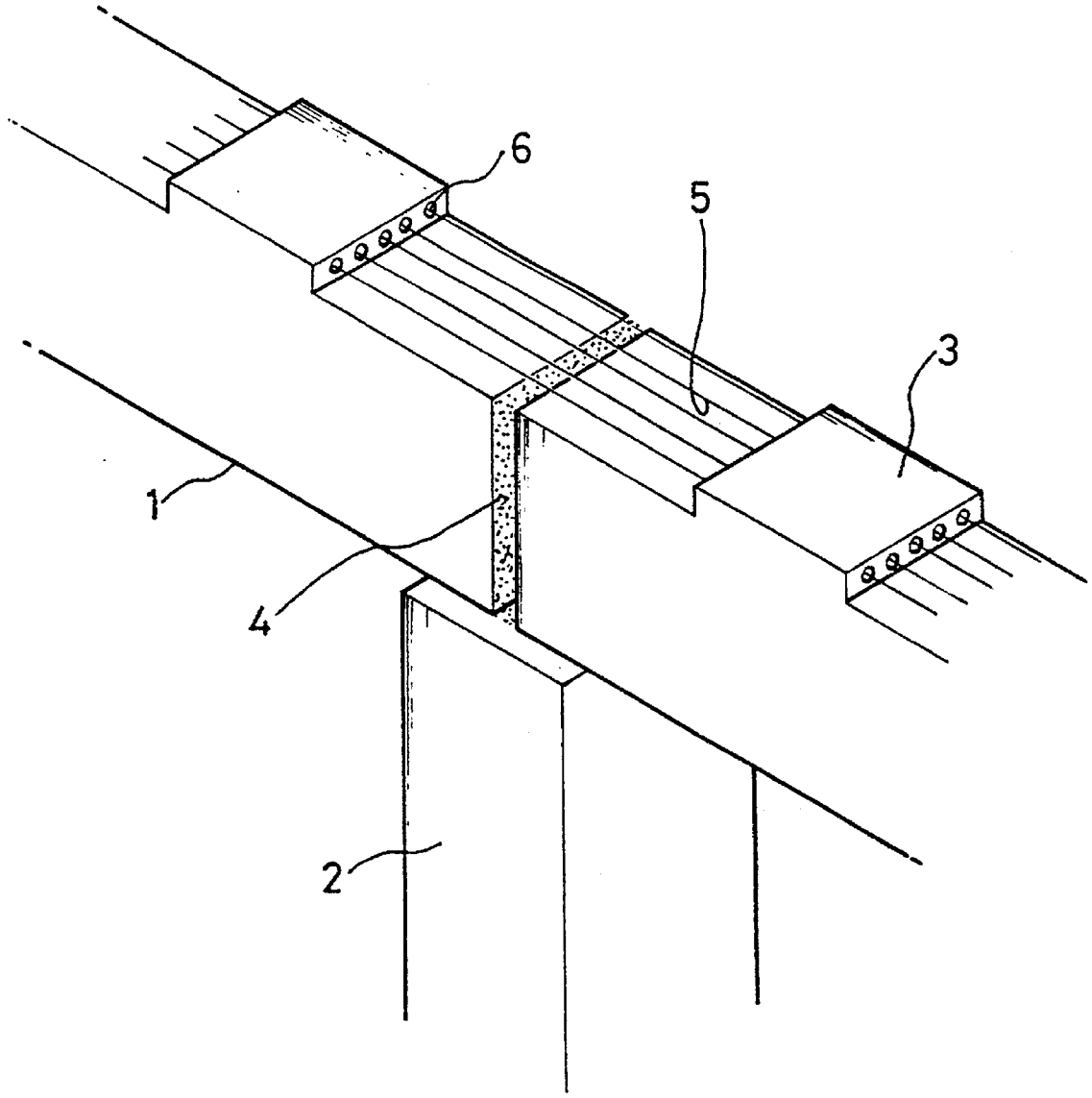
FIG. 4 is a perspective view of FIG. 3.
Figure 5:
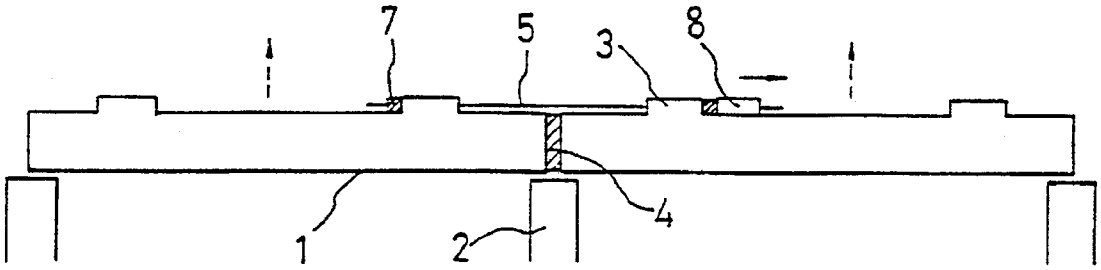
FIG. 5 is a schematic view showing the fourth step of connection work; tensioning work is performed, and at the same rate, the lifting forces are reduced.
Figure 5:
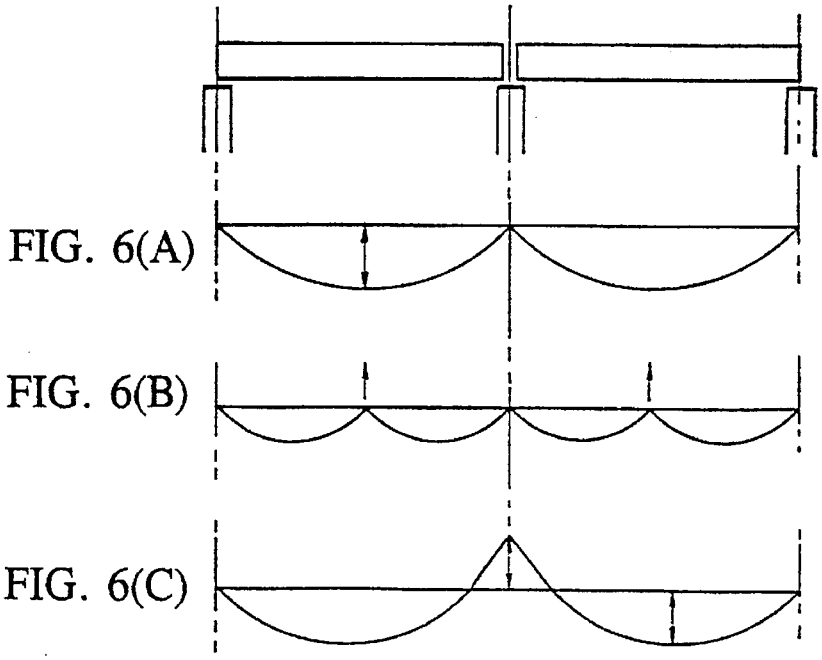

Two lifting forces are applied to the central points of the spans as shown in FIG. 2.

In order to provide lifting forces, temporary pier 20 and hydraulic jack 21 or lifting crane 11 or other lifting equipment can be used.

The lifting force is smaller than the self weight of a beam, so that the beams 1 do not move out from the piers 2.

The bending moment in the beams 1 has the form as shown in the diagram of FIG. 6(B).

c) Third step

Concrete 4 is placed into the gap between the ends of the beams 1 and cured.

After concrete 4 has hardened, tendons 5 are positioned through holes 6 of anchor blocks 3 projecting from the beams 1.

The lifting forces applied in the second step are maintained constantly during the third step.

d) Fourth step

Tensioning jack 8 and anchoring accessories 7 (wedges, nuts, etc.) are positioned.

Tensioning force is applied by tensioning jack 8 and at the same rate, the lifting forces applied to the midspans are reduced. That is, when the tensioning force is 30% of the target value, 70% of the lifting force is remaining.

As the tensioning work is finished, the lifting forces become zero and the tendons are anchored to the anchor blocks 3. Tensioning force is large enough so that the structural continuity of the beam is maintained.

Bending moment caused by the self-weight of the connected beam has the form as shown in the diagram of FIG. 6(C). Bending moment at the midspan is smaller than that of the individual beams shown in the diagram of FIG. 6(A).

The present connection method can be applied to connection of three or more spans with the same concept.

When the number of spans to be connected is very large, some of the spans are connected first, and then the other spans can be added to the connected spans one by one.

What is claimed is:

1. A method for connecting precast concrete beams comprising the steps of:

a) supporting the precast concrete beams at both ends with a gap between the ends of adjacent beams, b) applying uplifting forces to central points of the precast concrete beams, c) placing concrete into the gaps between the ends of adjacent precast concrete beams, and positioning tendons through anchor blocks which project from the precast concrete beams, d) tensioning the tendons and reducing the uplifting forces at the same rate, and then anchoring the tendons to the anchor blocks.

2. A method for connecting a pair of precast concrete beams each having opposite ends and at least one anchor block, the method comprising:

supporting the pair of concrete beams in adjacent end-to-end relation to one another so that both ends of each beam are supported and so that a gap exists between adjacent ends of the beams;

imparting a lifting force to each of the beams at a point intermediate the ends of each beam;

placing concrete into the gap;

positioning tendons through the at least one anchor block on each beam;

simultaneously tensioning the tendons and reducing the lifting force to each of the beams; and anchoring the tendons to the anchor blocks.

* * * * *